United States Patent [19]

Kawamoto

[11] 3,941,025

[45] Mar. 2, 1976

[54] ELECTRONIC EXPRESSION DEVICE FOR PRODUCING TREMULANT EFFECT

[75] Inventor: Kinji Kawamoto, Neyagawa, Japan

[73] Assignee: Matsushita Electric Industrial Co., Ltd., Osaka, Japan

[22] Filed: June 12, 1973

[21] Appl. No.: 369,214

Related U.S. Application Data

[63] Continuation of Ser. No. 266,348, June 26, 1972, abandoned, which is a continuation of Ser. No. 22,569, March 25, 1970, abandoned.

[52] U.S. Cl. ..... 84/1.25

[51] Int. Cl.[2] ..... G10H 1/02

[58] Field of Search ..... 84/1.01, 1.24, 1.25, DIG. 4; 331/106, 178

[56] References Cited

UNITED STATES PATENTS

| | | | |
|---|---|---|---|
| 2,835,814 | 5/1958 | Dorf | 331/106 |
| 2,916,706 | 12/1959 | Timperman | 84/1.24 X |
| 3,004,460 | 10/1961 | Wayne | 84/1.01 |
| 3,007,361 | 11/1961 | Wayne | 84/1.01 |
| 3,146,292 | 8/1964 | Bonham | 84/1.25 |
| 3,418,418 | 12/1968 | Wilder | 84/1.25 |
| 3,516,318 | 6/1970 | Wayne | 84/1.01 |
| 3,524,376 | 8/1970 | Heytow | 84/1.25 |

*Primary Examiner*—L. T. Hix
*Assistant Examiner*—Stanley J. Witkowski
*Attorney, Agent, or Firm*—Wenderoth, Lind & Ponack

[57] ABSTRACT

Electronic expression device for producing a novel tremulant effect. The device has a frequency range separator separating an audio frequency signal into a plurality of sub-band signals at least one modulation system being connected to the frequency range separator in order to modulate the sub-band signals other than the lowest sub-band signal, and a coupling means for coupling the output signals of the modulation systems and the lowest sub-band signal. Each of the modulation systems has at least one modulator having a characteristic such that at least the modulation depth increases in accordance with an increase in the frequency of the input signal and the modulation depth exceeds $\pm\pi/2$ radian for phase modulation and 100 percent for amplitude modulation in a high frequency range.

The audio frequency signal applied to the input terminal is translated in such a manner that frequency spectra of the signal are fluctuating differently with respect to the frequency, phase and amplitude from each other in high frequency ranges corresponding to the sub-band signals except the lowest, but are not fluctuating in the lowest sub-band frequency range.

16 Claims, 22 Drawing Figures

INVENTOR
KINJI KAWAMOTO

BY Wenderoth, Lind & Ponack
ATTORNEYS

INVENTOR
KINJI KAWAMOTO

BY Wenderoth, Lind & Ponack
ATTORNEYS

INVENTOR
KINJI KAWAMOTO

BY Wenderoth, Lind & Ponack
ATTORNEYS

INVENTOR
KINJI KAWAMOTO

BY Wenderoth, Lind & Ponack
ATTORNEYS

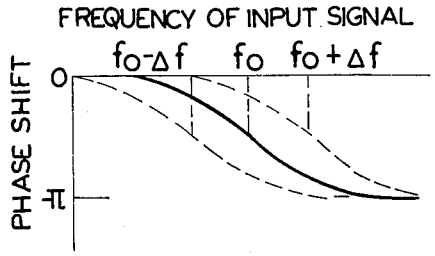
FIG. 18
FIG. 19
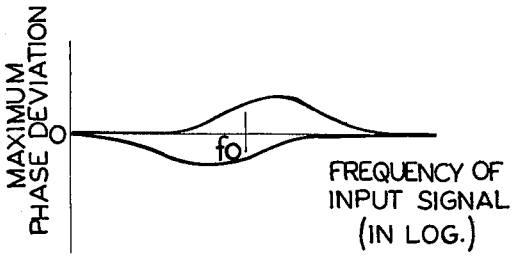
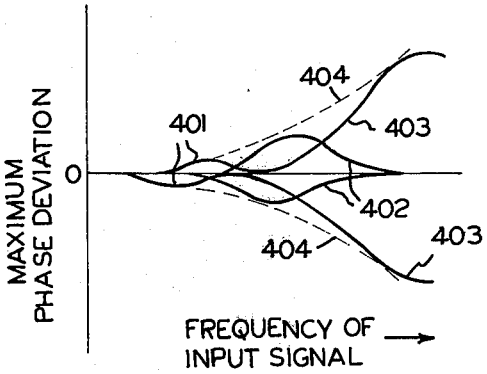
FIG. 20
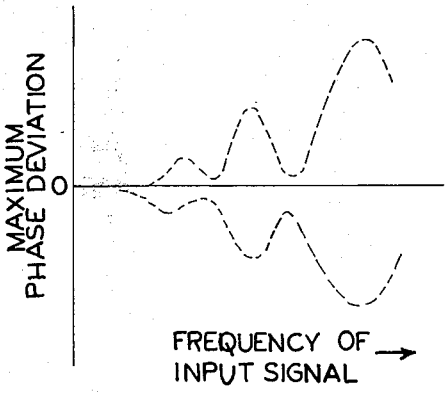
FIG. 21
INVENTOR
KINJI KAWAMOTO
BY Wenderoth, Lind & Ponack
ATTORNEYS

ELECTRONIC EXPRESSION DEVICE FOR PRODUCING TREMULANT EFFECT

This is a continuation, of application Ser. No. 266,348, filed June 26, 1972, and now abandoned, which in turn is a continuation of Ser. No. 22,569, filed Mar. 25, 1970, and now abandoned.

FIELD OF THE INVENTION

The present invention relates to an electronic expression device for achieving a tremulant effect and a chorus effect by processing an audio frequency signal, and more particularly relates to an electronic expression device which is capable of translating each of the spectra of the audio frequency signal so that they vary in frequency, phase and amplitude.

DESCRIPTION OF THE PRIOR ART

A conventional tremulant effect in a pipe organ is achieved by fluctuating the pressure of the air and producing amplitude and frequency fluctuation. A conventional celeste effect or an ensemble effect in a pipe organ is achieved by providing the beats between pipes which are purposely detuned slightly with respect to one another. A conventional vibrato effect in an electronic organ is achieved by frequency modulation. A conventional tremolo effect in an electronic organ is achieved by amplitude modulation.

The above-mentioned effects are due to the fluctuation of the vectors, i.e. spectra, of the audio frequency signal. The vibrato effect is due to angular fluctuations of constant amplitude vectors. The tremolo effect is due to amplitude fluctuations of constant angle vectors. The tremulant effect of a pipe organ is similar to a beat effect and is due to amplitude fluctuations and angular fluctuations of the vectors. The celeste effect or the ensemble effect of a pipe organ is the beat effect which is explained by the fluctuations of the vectors having the ends moving on a circular locus.

The following description explains the reasons why the above-mentioned effects of the pipe organ are superior to the conventional vibrato and tremolo effects of the electronic organ.

The first reason is the tonal quality. The beat effect of a pipe organ has a better tonal quality with respect to both strength and clearness than the tone of an electronic organ produced by frequency or phase modulation corresponding to the angular fluctuation of the vector and amplitude modulation corresponding to a change of amplitude of the vector.

The second reason is the difference in the complexity of the effect. The fundamental beat frequencies between the tuned pipes and the slightly detuned pipes are respectively different from each other due to the different pitches of the tuned pipes. The beat frequencies between harmonics of the tuned pipes and the detuned pipes are also different from each other, respectively, according to the order of the harmonics. That is, when several pipes sound together, the beat frequencies of the pipes are numerous and their relation is very complex, so the chorus or the ensemble effect is completely achieved. Contrary to the celeste effect or the ensemble effect of a pipe organ, the vibrato effect and the tremolo effect of an electronic musical instrument are monotonous because usually only one vibrato frequency and tremolo frequency are used.

The third is in the spatial distribution, i.e. the spread effects of sounds. The pipe organ has many pipes arranged in the pipe room and the sounds of pipes are heard from different directions. A conventional technique to get a spread of the sounds in an electronic organ is to use a multi-modulator and reproducer system similar to the system described in U.S. Pat. No. 3,083,606.

Even if said multi-modulator and reproducer system is used, however, lack of the complex beat effect and the defect of the monotonous impression are not overcome.

Another conventional technique to improve the above-mentioned defects and to get a spread of sounds is to use a rotating loud speaker.

But the mechanical rotating speaker construction has many defects, for example, difficulty in starting and stopping instantly, difficulty in controlling the rotating speed, difficulty in changing the depth of modulation, necessity of maintenance and generation of rotating noises.

A further technique for improving an electronic organ to overcome the above-mentioned defects and to get a spread of sounds is described in my copending application Ser. No. 389,203, filed Aug. 17, 1973, and now abandoned, which is a continuation of application Ser. No. 245,803, filed Apr. 18, 1972, and now abandoned which is a continuation of application Ser. No. 826,190. filed May 20, 1969, and now abandoned.

Some modifications to said further technique have been found to improve the effect of processing music in the low frequency range.

SUMMARY OF THE INVENTION

It is a primary object of the present invention to provide an electronic expression device for producing an improved vibrato and a tremolo effect used widely in music by complicating the motions of the frequency vectors of an audio frequency signal and by reducing the impression of a monotonous fluctuation.

Another object of the present invention is to provide an electronic expression device characterized by a tremulant effect in which the magnitude and the frequency of the fluctuation of the spectra of the audio frequency signal is small in the low frequency range and large in the high frequency range.

It is a further object of the present invention to provide an effective way to reduce and further eliminate uncomfortable trembling and shaking in the bass part of the music caused by the fluctuation of the low frequency spectra of the signal.

It is a further object of the invention to provide an electronic expression device characterized by a tremulant effect in which at least either the magnitude or the frequency of fluctuation of the vectors of the audio frequency signal increases with an increase in the frequency of the audio frequency signal so that simultaneous fluctuation decreases.

A further object of the present invention is to provide a method for adding a tremulant effect which gives only a slight impression of a simultaneous fluctuation to signals of an electronic and electric musical instrument, a conventional musical instrument, a recorded disc, a recorded tape, a human voice, and so on.

A further object of the present invention is to provide a method for producing a new fluctuation effect which is different from the conventional vibrato and tremolo effects by use of a system comprising a plurality of channels, at least one of which has modulation means as a part thereof.

A further object of the present invention is to provide a tremulant effect having a spatial distribution and a spread of sounds.

A further object of the present invention is to provide a beat-like fluctuation of a tone having more strength and clearness of tonal quality than the conventional vibrato and tremolo effects.

A further object of the present invention is to provide a tremulant effect which does not give the impression of a simultaneous fluctuation by using a delay line, a phase shifter or a phase splitter, the split phase of which increases in accordance with an increase in the frequency of the input signal.

A further object of the present invention is to provide an easy way to control the depth and speed of the fluctuations.

A further object of the present invention is to provide a novel tremulant effect by converting an audio frequency signal into a plurality of signals at least one of which is overmodulated, that is, the phase modulation depth is more than $\pm\pi/4$ radians, and preferably more than $\pm\pi/2$ radians, or the amplitude modulation ratio exceeds 100 percent, especially in the high frequency range.

The objectives are achieved by employing an electronic expression device for producing a tremulant effect according to the present invention comprising a frequency range separator separating an audio frequency signal into a plurality of sub-band signals; at least one modulation system having a plurality of transmission channels coupled to said frequency range separator through one distributing means, at least one of said transmission channels being provided with modulation means for producing modulation signals which have a frequency in a sub-audio frequency range and at least one of which is different in phase from the remainder, whereby each of said sub-band signals other than the lowest is fed to said distributing means to form plural distributed signals which are converted into plural transmitted signals through said plural transmission channels; and coupling means for coupling all of said transmitted signals and said lowest sub-band signal with each other electrically and/or accoustically, said modulation means modulating said distributed signals in such a manner that the modulation depth and/or the modulation frequency increase with an increase in the frequency of said distributed signals.

BRIEF DESCRIPTION OF THE DRAWINGS

These and other objects and particulars of the present invention will be made clear from the following detailed description of the invention considered together with the accompanying drawings, wherein:

FIG. 1*a* is a schematic block diagram of an alternative coupling means which can be used in the device of FIG. 1;

FIG. 18 is a diagram of the phase characteristic of the phase shifting circuit shown in FIG. 12;

FIG. 19 is a diagram of the phase deviation characteristic of the phase shifting circuit shown in FIG. 12;

FIG. 20 is a diagram of an example of the phase deviation characteristic of a modulation means; and FIG. 21 is a diagram of another example of the phase deviation characteristic of a modulation means.

DETAILED DESCRIPTION

Figure 1:
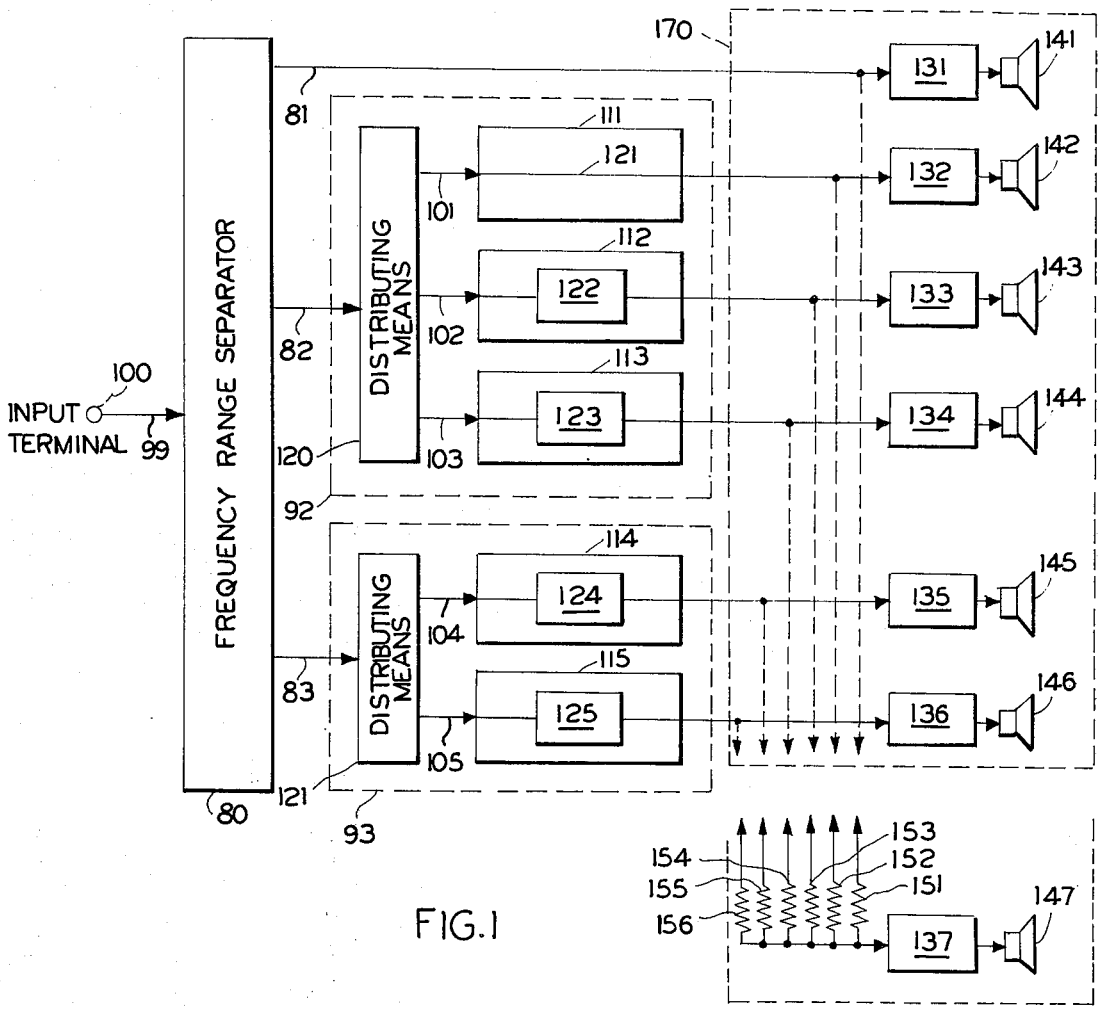
FIG. 1 is a schematic block diagram of an embodiment of an electronic expression device for producing a tremulant effect according to the present invention.

Referring to FIG. 1, an audio frequency signal applied to an input terminal 100 is led through a connecting means 99 to a frequency range separator 80 and is separated by the frequency range separator 80 into a plurality of sub-band signals having different frequencies in the audio frequency range, for example three sub-band signals. The lowest frequency signal of the three sub-band signals is fed to a coupling means 170 through a lead 81. The frequency range separator 80 is coupled to at least one modulation system, for example two modulation systems 92 and 93 through leads 82 and 83, respectively.

The modulation system 92 has three transmission channels 111, 112 and 113 connected through leads 101, 102, and 103, respectively, to a distributing means 120 which is connected to the lead 82. The modulation system 93 has two transmission channels 114 and 115 connected through leads 104 and 105, respectively, to a distributing means 121 which is connected to the lead 83. Among those five transmission channels 111–115, at least one transmission channel, for example four transmission channels 112–115, have modulation means 122–125 therein, respectively. The modulation means 122–125 produce modulation signals which have a frequency in a sub-audio frequency range. At least one of said modulation signals is different in phase from the remainder. Accordingly, at least one of the output signals from the four modulated transmission channels has a different modulation from the other output signals.

The sub-band signals other than the lowest are fed to the distributing means 120 and 121 through leads 82 and 83 where they are divided into five distributed signals which are converted into five transmitted signals through said five transmission channels 111–115. The five transmitted signals are fed to a coupling means 170.

Said five transmitted signals and the lowest sub-band signal fed through the lead 81 are coupled electrically and/or accoustically together by the coupling means 170.

Said modulation means 122–125 modulate, respectively, said four distributed signals in such a manner that the modulation depth and/or the modulation frequency increase with an increase in the frequency of said distributed signals.

Among three sub-band signals, the sub-band signal of the lead 81 is in the lowest frequency range; The sub-band signal of the lead 83 is in the highest frequency range; and the sub-band signal of the lead 82 is in a frequency range between the former two signals. When the two boundaries between each two sub-band signals are located, for example, at 250 Hz and 1000 Hz, the lowest sub-band signal ranges between 20Hz and 250Hz, the middle sub-band signal ranges between 250 Hz and 1,000 Hz, and the highest sub-band signal ranges between 1,000 Hz and 20,000 Hz. The frequency range separator 80 can be formed from a low pass filter, a band pass filter, and a high pass filter.

The distributing means 120 and 121 can be simply formed of leads connecting the leads 82, 101, 102 and 103 and the leads 83, 104 and 105, respectively. The sub-band signals passing through the distributing means 120 and 121 do not have the frequency spectrum changed and preferably have the phase changed.

The coupling means 170 has amplifiers 131–136 connected to electro-acoustic transducers 141–146, respectively. The lowest sub-band signal passing through the lead 81 enters the electro-acoustic transducer 141 through the amplifier 131. The transmitted signals from transmission channels 111–115 enter the acoustic-transducers 142–146 through the amplifiers 132–136, respectively.

Instead of said six amplifiers 131–136 and said six electro-acoustic transducers 141–146, one can use, as shown in FIG. 1*a*, a coupling means 170*a* which is a combination of one amplifier 137 and one electro-acoustic transducer 147 connected to the lead 81 and to the transmission channels 111–115 through resistors 151–156, respectively.

At least one of the transmission channels 111, 112 and 113 in the modulation system 92 and the transmission channels 114 and 115 in the modulation system 93 have a modulation means, respectively, for example 122, 123, 124 and 125. Referring to FIG. 1, the modulation system 92 has the transmission channel 111 which has no modulation means but consists only of a lead 111a.

The modulation means 122–125 produce modulation signals each of which has a frequency in a sub-audio frequency range, for example from 0.5 Hz to 10 Hz. Among said modulation signals, at least one modulation signal is different in phase from the remainder.

The modulation means 122–125 preferably modulate the distributed signals of the leads 102–105 in such a manner that the modulation depth and/or the modulation frequency increase with an increase in the frequency of said distributed signals fed to the modulation means 122–125. It is more preferable to have the maximum modulation depth exceeding $\pm\pi/2$ radian for the phase modulation and the maximum modulation depth exceeding 100 percent for the amplitude modulation.

Figure 2:
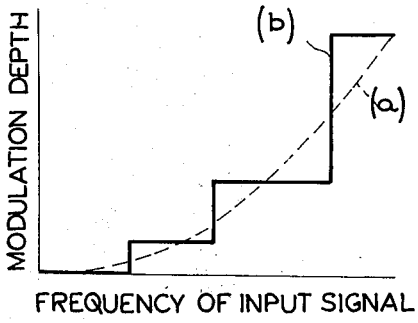
FIG. 2 is a diagram of the modulation depth vs the input frequency characteristic of the modulation means.
Figure 3:
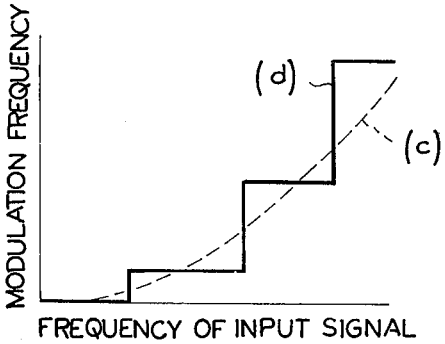
FIG. 3 is a diagram of the modulation frequency vs the input frequency characteristic of the modulation means.

Two examples of the modulation depth vs audio frequency characteristic are shown in FIG. 2. The dotted line (a) shows a continuous increase in the modulation depth with an increase in the frequency of the input audio frequency signal. The solid line (b) shows a stepwise increase in the modulation depth with an increase in the frequency of the input modulation frequency signal. FIG. 3 shows two examples of the modulation frequency vs audio frequency characteristic. The dotted line (c) shows a continuous increase and the solid line (d) shows a stepwise increase with an increase in the frequency of the signal.

According to the embodiment of the device shown in FIG. 1, the signal in the lowest sub-band of frequency containing the bass part of the music is led through the frequency range separator 80 and the lead 81 to the power amplifiers 131 or 137 and the electro-acoustic transducers 141 or 147 without being modulated by any modulation means so that no uncomfortable trembling and shaking occur in the lowest sub-band which contains the bass part of the music. On the other hand, the sub-band signals of the leads 82 and 83, which is higher in frequency than the lowest sub-band signal and contains the melody part of the music, are converted into plural transmitted signals by the modulation system 92 and 93 and are coupled together by the coupling means 170, and finally are changed into a signal with frequency spectra, each of which fluctuates in a different manner from each other.

Figure 4:
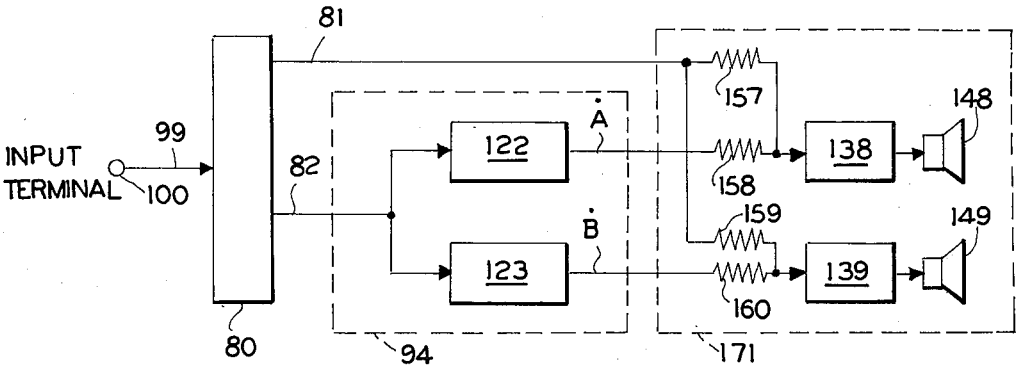
FIG. 4 is a schematic block diagram of the second embodiment of the device of the present invention.

Referring to FIG. 4, an audio frequency signal applied to an input terminal 100 is led to a frequency range separator 80 through a connecting means 99 and is separated into two sub-band signals of audio frequency. Said two sub-band signals appear in leads 81 and 82, respectively. The first sub-band signal of lead 81 is lower in frequency than the second sub-band signal of the lead 82.

The frequency range separator 80 can be formed of a low pass filter and a high pass filter, the cross over frequency of which is, for example, 250 Hz. Although a suitable cross-over frequency usually ranges between 200 Hz and 400 Hz, it depends on the characteristic of the filters and the spectra of the audio frequency signal.

The lead 82 connects the frequency range separator 80 to a modulation system 94. The modulation system 94 is a modified system of the modulation system 92 shown in FIG. 1. The modulation system 94 has two modulation means 122 and 123, both of which are connected to the lead 82. The lower sub-band signal of lead 81 and the transmitted signal from the modulation means 122 and 123 are fed into a coupling means 171.

The coupling means 171 couples the lower sub-band signal of the lead 81 and the transmitted signal from the modulation means 122 electrically through an electrical coupling means comprising resistors 157 and 158 and transduces them into sound by an electro-acoustic transducer 148 through a power amplifier 138. The coupling means 171 also couples the lower sub-band signal of the lead 81 and the transmitted signal from the modulation means 123 electrically through a coupling means comprising resistors 159 and 160 and transduces them into sound by a power amplifier 139 and an electro-acoustic transducer 149. The sounds radiated from the electro-acoustic transducers 148 and 149 are coupled acoustically in the air.

The modulation means 122 and 123 produce modulation signals of sub-audio frequency, respectively. The modulation signals differ in phase from each other, for example by $\pi$ radians and have the same frequency. The modulation means 122 and 123 modulate the distributed signals, i.e. the input signals to said modulation means 122 and 123, so that they have a different modulation from each other in such a manner that the modulation depth and/or the modulation frequency increase with an increase in the frequency of said input signals. The modulation means 122 and 123 preferably have a maximum modulation depth exceeding $\pm\pi/2$ radian for phase modulation and a maximum modulation depth exceeding 100 percent for amplitude modulation.

Referring to FIG. 4, the lower sub-band signal of lead 81, which contains the bass part of the music, is not modulated by any modulation means and no unpleasant trembling or shaking occurs. On the other hand, the higher sub-band signal of the lead 82, which is higher in frequency than the lower signal and contains the melody part of the music is processed by the modulation system 94 and the coupling means 171 in order to be changed into signals with frequency spectra which fluctuate in a different manner from each other.

The basic effects of the modulation will be explained with reference to FIG. 5. An audio frequency signal such as music generally has many frequency spectra. Each spectrum can be represented by a frequency vector on a vector diagram.

Figure 5:
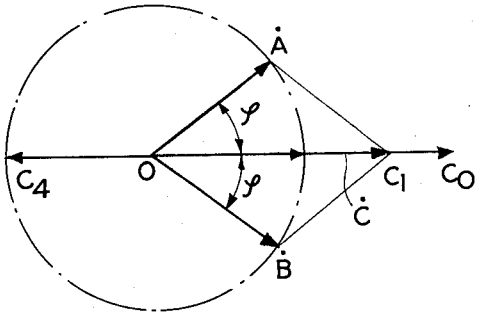
FIG. 5 is a vector diagram explaining the operation of the device of FIG. 4.

FIG. 5 is a vector diagram of an output signal A of the modulation means 122, an output signal B of the modulation means 123 and a signal C corresponding to the sound coupled in the air after being transduced by the resistors 158 and 160, the power amplifiers 138 and 139, and the electro-acoustic transducers 148 and 149. In FIG. 5, the signal at the lead 82 is shown by the vector OI. The modulation means 122 shifts the vector OI to vector A which is shifted in phase from vector OI by a maximum of $\phi$ radians, and the modulation means 123 shifts the vector OI to a vector B, which is shifted in phase from vector OI by a maximum of $-\phi$ radians. Thus, the vector A and the vector B are symmetrical with respect to the vector OI. The sum of the vectors A and B is a vector C.

When the maximum phase deviation produced by the modulation means 122 and 123 is $\phi$ radians at an input frequency f of the signal, the vectors A and B move symmetrically to each other between angle $-\phi$ and $+\phi$; the vector C, which is the sum of the vectors A and B, expands and contracts in length between $OC_1$ and $OC_0$. When said maximum phase deviation is between zero and $\pi 12$ radians, the length of the vector C changes between zero and $OC_0$, and the frequency of the expansion and contraction is twice the modulation frequency of said modulation means 122 and 123. When said maximum phase deviation is between $\pi/2$ and $\pi$ radians, the vectors A and B move symmetrically to each other between angle $-\phi$ and $+\phi$, where $\phi$ is between $\pi/2$ and $\pi$ radians. The vector C expands and contracts between $C_4$ and $C_0$ as well as between $C_0$ and 0, and the vector C expands and contracts four times during a modulation period. In general, when said maximum phase deviation is between $$\frac{n\pi}{2} \text{ and } \frac{(n+1)\pi}{2} \text{ radians,}$$

where n is zero or a positive integer, the frequency of the expansion and contraction is $2(n+1)$ times as great as the modulation frequency. As said maximum phase deviation increases with an increase in the input frequency $f$, the modulation depth increases initially and then the frequency of modulation increases with an increase in the input frequency.

By the operation described above, the embodiment of the present invention shown in FIG. 4 converts the input audio frequency signal into a new signal having the characteristic that at least either the modulation depth or the modulation frequency increases with an increase in the frequency of the input audio signal.

When the position of a listener is equally distant from the electro-acoustic transducers 148 and 149, acoustic signals radiated from said transducers 148 and 149 are equally delayed in reaching the listener's position and then are coupled together. The amplitude of the coupled signal is a maximum at all the frequencies at the moment when the phase deviations of the modulation means 122 and 123 are zero radians; that is, when the acoustic signal has a plurality of vectors corresponding to the frequency spectra of said acoustic signal, all the vectors become maximum in amplitude at the same time.

But, when the listener's position is not equally distant from the electro-acoustic transducers 148 and 149, the acoustic signals travel from said transducers 148 and 149 to the listener's position in different lengths of time. Therefore, the phase difference between said acoustic signals at the listener's position increases in proportion to the frequency of the acoustic signals. Even when the phase deviation of the modulators 122 and 123 is zero radians, there is a phase difference increasing with an increase in the frequency of the acoustic signal and the amplitude of the coupled signal is not maximum in all the frequencies at the same time. Consequently, fluctuations of the vectors of the signal produced by the embodiment of FIG. 4 become very complex.

The modulated signals produced by the modulation means 122 and 123 do not need to have exactly opposite phases.

Figure 6:
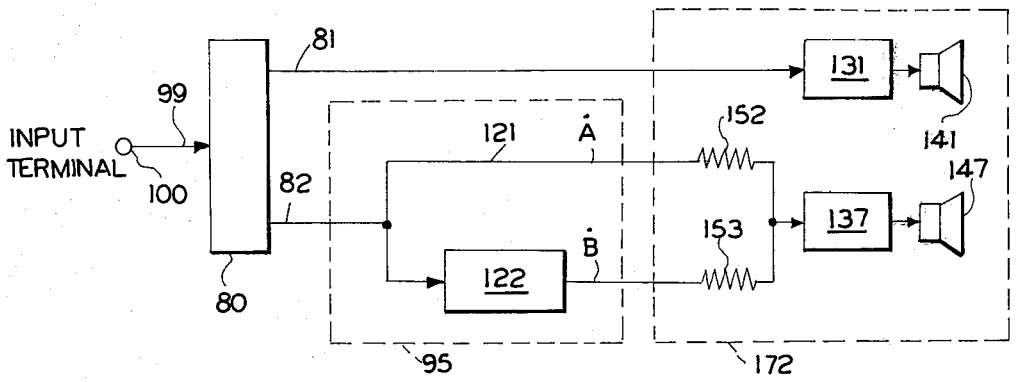
FIG. 6 is a schematic diagram of the third embodiment of the device of the present invention for producing a beat-like effect.

Referring to FIG. 6, an audio frequency signal applied to an input terminal 100 is led through a connecting means 99 to a frequency range separator 80 and is separated into two sub-band signals of audio frequency. For example, the lower sub-band signal contains frequency spectra from 20 Hz to 250 Hz and the higher sub-band signal contains from 250 Hz to 20,000 Hz. The lower sub-band signal appears at the lead 81 and the higher sub-band signal appears at the lead 82. The lead 82 connects a modulation system 95 to the frequency range separator 80.

The modulation system 95 is a modified system similar to the modulation system 92 in FIG. 1. Referring to FIG. 1, if the leads 103, the transmission channel 113 and the modulation means 123 are eliminated and the distributing means 120 is a lead connecting the lead 82 to the leads 101 and 102, then the modulation system 95 as shown in FIG. 6 is obtained. The lower sub-band signal from the lead 81 is put through a power amplifier 131 to an electro-acoustic transducer 141 and transduced into sound. The higher sub-band signal from the lead 121 and the output signal from the modulation means 122 are coupled together by an electrical coupling means comprising resistors 152 and 153, and transduced into sound by a power amplifier 137 and an electro-acoustic transducer 147. A coupling means 172 is comprised of the resistors 152 and 153, the power amplifiers 131 and 137, and the electro-acoustic transducers 141 and 147. The modulation means 122 modulates the distributed signal identical with the sub-band signal from the lead 82 in such a manner that the modulation depth and/or the modulation frequency increase with an increase in the frequency of the distributed signal of the lead 82. The signal B is modulated in the modulation means 122 and the signal A in the lead 121 is not modulated. Accordingly, each of the signals A and B is considered to have a different modulation. The modulation means 122 preferably has a maximum modulation depth exceeding $\pm\pi/2$ radian for phase modulation and a maximum modulation depth exceeding 100 percent for amplitude modulation.

Figure 7:
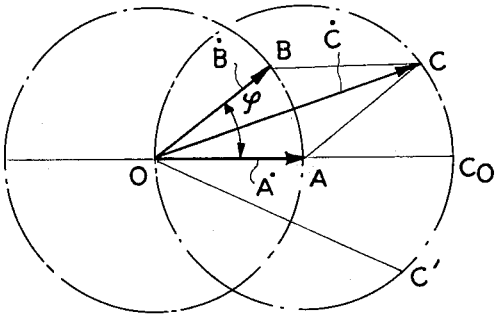
FIG. 7 is a vector diagram explaining the operation of the device of FIG. 6.

FIG. 7 shows a vector diagram of output signals A and B from the modulation system 95 and a signal C which corresponds to the combined signal coupled through the resistors 152 and 153. The signal of the lead 82 is essentially the same as the signal A. The modulation means 122 converts the vector A into the vector B which is shifted from the vector A by $\phi$ radian. A vector C, i.e. a sum of the vectors A and B, moves on a circular locus $OCC_0$ in accordance with the rotation of the vector B on a circle with a center O and a radius OA. As the angle of vector B fluctuates between $\phi$ radian and $-\phi$ radian, the vector C moves between C and C'. As a result, the motion of the vector C resembles the beat, and the tonal quality of the sound represented by the vector C has a strength and clearness similar to the beat. Because the maximum phase deviation of the modulation means 122 increases with an increase in the input frequency, the vector B travels faster on the circle having the center O with an increase in the frequency of the input signal.. The fluctuation of the vector C also increases initially in depth and then in frequency with an increase in the input frequency.

When the coupling means 171 shown in FIG. 4 is used instead of the coupling means 172 shown in FIG. 6 the vector C does not become a maximum at the moment when the phase deviation is zero radians at a listener's position which is not equally distant from the electro-acoustic transducers 148 and 149. Consequently, a more complex fluctuation of the audio frequency signal is produced.

The following is a description of modulation means which can be used in the device of the present application. The modulation depth of a conventional modulator has been limited to the range between 0 percent to 100 percent for amplitude modulation and between $-\pi/4$ radian to $\pi/4$ radian for phase modulation and the modulation depth has been constant, regardless of the frequency of the signal which is to be modulated.

When the amplitude modulation depth exceeds 100 percent, i.e. overmodulation, or when the phase modulation depth exceeds $\pm\pi/2$ radians, a more complex effect is produced, as mentioned above.

The first embodiment of a modulation means for the device according to the invention has a construction in which the phase shift characteristic or the delay time of a delay network fluctuates.

Figure 8:
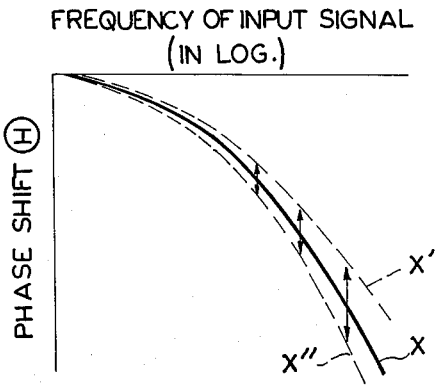
FIG. 8 is a diagram of the phase vs frequency characteristic of another embodiment of the modulation means which is used in the device according to the present invention for processing music.
Figure 9:
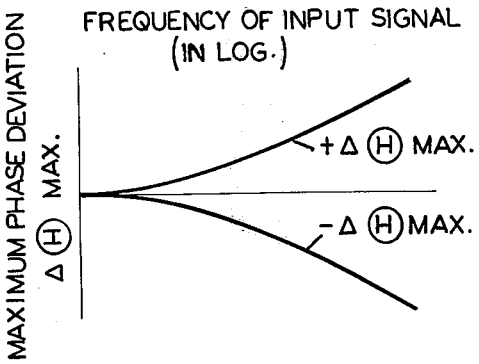
FIG. 9 is a diagram of the phase deviation vs frequency characteristic of the modulation means for which the phase vs frequency characteristic is shown in FIG. 8.

FIG. 8 shows a phase shift characteristic X of a delay network. The phase shift of FIG. 8 increases exponentially with a logrithmic increase of the frequency of the input signal. When the delay time of the delay network fluctuates, the phase shift characteristic fluctuates between X' and X'', as shown in FIG. 8, and phase modulation occurs in such a manner that the maximum phase deviation $+\Delta_{max}$ and $-\Delta_{max}$ of said phase modulation increases with increasing frequency of the input signal as shown in FIG. 9.

Figure 10:
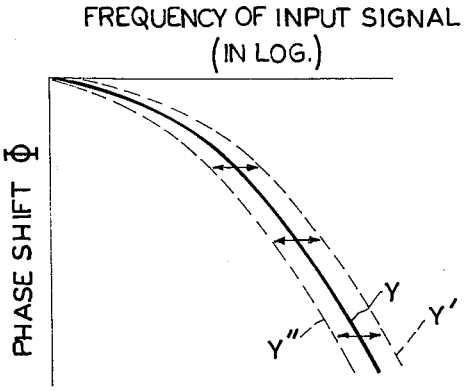
FIG. 10 is a diagram of the phase vs frequency characteristic of a further example of the modulation means which is applicable to the device of the present invention for processing music.
Figure 11:
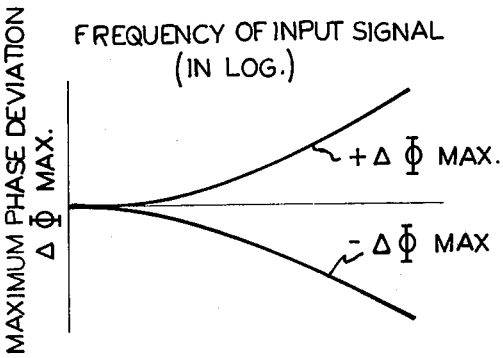
FIG. 11 is a diagram of the phase deviation vs frequency characteristic of the modulation means for which the phase vs frequency characteristic is shown in FIG. 10.

The second embodiment of a modulation means for the device according to the invention is one in which the phase shift characteristic fluctuates. An example of a circuit diagram of such an embodiment will be shown hereinafter. The curved line Y in FIG. 10 shows a phase shift characteristic in which the rate of the increment of the phase shift $\Phi$ increases with an increase in the frequency of the input signal. If the curved line Y fluctuates in a direction parallel to the frequency axis between a curved line Y' and another curved line Y'', a phase deviation from the curved line Y occurs between the maximum phase deviation $+\Delta\Phi_{max}$ and $-\Delta\Phi_{max}$ as shown in FIG. 11. The phase deviation characteristic $\pm\Delta\Phi_{max}$ as shown in FIG. 11 is also usable in a device according to the invention. Such a modulation means is shown in FIG. 12

Figure 12:
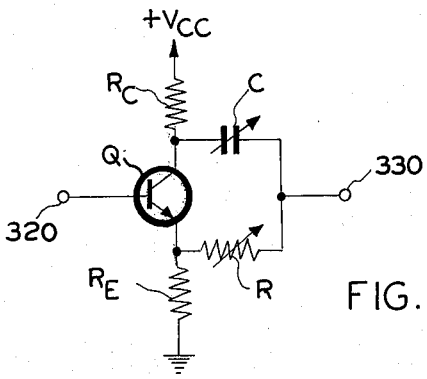
FIG. 12 is a circuit diagram of an example of a phase shifting circuit.

The phase shifting circuit of FIG. 12 comprises a variable resistor R, a variable capacitor C and a phase splitter which is composed of a transistor Q, and resistors $R_E$ and $R_c$ ($=R_E$). Said transistor Q splits the signal applied to an input terminal 230 into a pair of signals which are opposite in phase, and the pair of signals is coupled together through a coupling device comprising the resistor R and the capacitor C at the output terminal 330.

The transfer function G(s) of the phase shifting circuit shown in FIG. 12 is:

$$G(s) = \frac{1-s}{1+s}, \qquad (1)$$

where s is a complex angular frequency. The amplitude transfer characteristic of the equation (1), i.e. the gain of the phase shifting circuit, is constant regardless of the frequency, and the phase characteristic changes from zero to $-\pi$ radians as the frequency increases, as shown in the curved line z of FIG. 13.

The phase of the signal is shifted by $-\pi/2$ radians at a center frequency $f_0$ $\frac{1}{2} = \pi_{RC}$. The center frequency $f_0$ and the phase shifting characteristic changes with variations in the resistance of the resistor R, the capacitance of the capacitor C, or both the resistance of the resistor R and the capacitance of the capacitor c. By connecting a plurality of the phase shifting circuits in cascade and equalizing each center frequency of the phase shifting circuits, a total phase shifting characteristic in the shape of the curved line z' of FIG. 13 can be obtained. A phase shifting characteristic as shown in FIG. 10 and a phase deviation characteristic as shown in FIG. 11 can be obtained by setting the center frequency $f_o$ to a value near the highest frequency of the audio frequency range and causing the center frequency $f_o$ to fluctuate by changing the resistance of the resistor R, the capacitance of the capacitor C, or both the resistance of the resistor R and the capacitance of the capacitor C.

Figure 14:
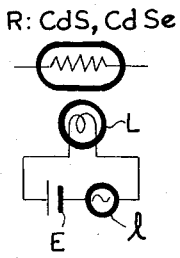
FIG. 14 is a circuit diagram of an example of a variable resistor.

FIG. 14 shows an example of means for causing the resistance of the resistor R to fluctuate. The resistor R is, for example, a photo-sensitive resistor such as CdS or a CdSe element exposed to the light of a lamp L which is lighted not only by a D.C. power supply E for biasing the value of the resistor R to some central value, but also by an A.C. modulating signal e which causes the value of the resistor R to fluctuate around said central value.

The transistor Q can be replaced by a vacuum tube, a field effect transistor or a transformer. The resistor R can be replaced by any variable resistor such as a Hall effect element. The capacitor C can be replaced by any reactor such as an inductor.

Figure 15:
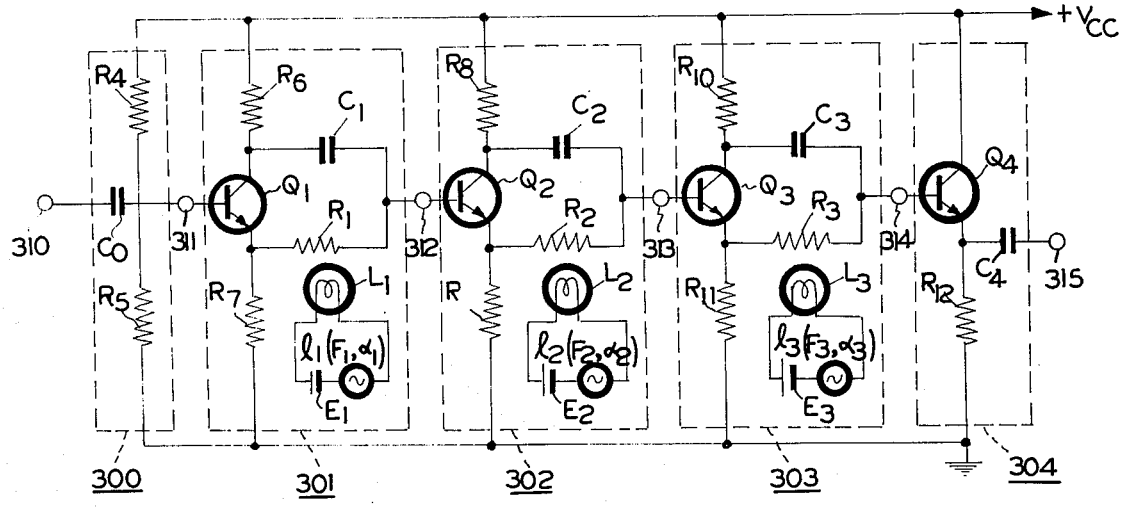
FIG. 15 is a schematic block diagram of an embodiment of a modulation means comprising the phase shifting circuits shown in FIG. 12.

FIG. 15 shows an example of a modulation means which comprises three phase shifting circuits 301, 302 and 303, each corresponding to the circuits of FIGS. 12 and 14, a biasing circuit 300 and an emitter follower circuit 304 connected in cascade. An audio frequency signal applied to an input terminal 310 is fed through a coupling capacitor $C_o$ and a terminal 311 to the base of the transistor $Q_1$, which is biased by resistors $R_4$ and $R_5$, and appears at an output terminal 312. The signal at the terminal 312 is fed through a similar phase shifting circuit 302 to the terminal 313 and then through another similar phase shifting circuit 303 to the terminal 314 of an emitter follower circuit 304 and finally appears at the low impedance output terminal 315.

The resistors $R_1$, $R_2$ and $R_3$ of the phase shifting circuits 301, 302 and 303, respectively, are photo senstive resistors such as a CdS or a CdSe element exposed to the light of the lamps $L_1$, $L_2$ and $L_3$, respectively, which are lighted by D.C. power supplies $E_1$, $E_2$ and $E_3$ for biasing each of the resistors $R_1$, $R_2$ and $R_3$, respectively, at some central values and which are further lighted by A.c. modulated power supplies $e_1$, $e_2$ and $e_3$ in order to cause the resistance of the resistors $R_1$, $R_2$ and $R_3$ to fluctuate at frequencies $F_1$, $F_2$ and $F_3$ and phases $\alpha_1$, $\alpha_2$, $\alpha_3$, respectively, around the central values.

Figure 13:
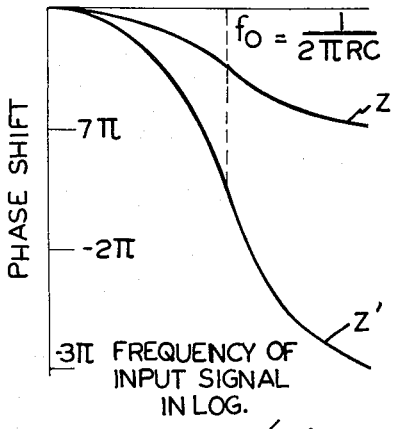
FIG. 13 is a diagram of the phase characteristic of the circuit shown in FIG. 12 and the phase characteristic of a further embodiment of the modulation means.

The phase shifting circuits 301, 302 and 303 have, for example, a phase shifting characteristic according to the curved line Z as shown in FIG. 13, and have center frequencies $$\frac{1}{2\pi R_1C_1},\ \frac{1}{2\pi R_2C_2}\ \text{and}\ \frac{1}{2\pi R_3C_3},$$

respectively.

Figure 16:
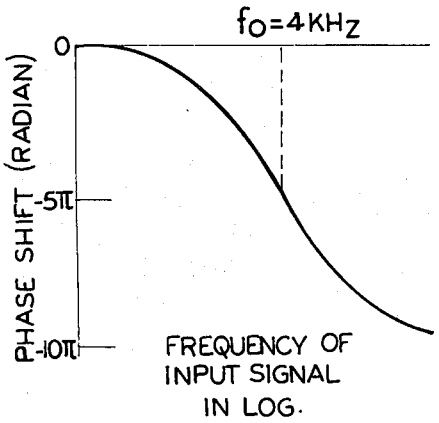
FIG. 16 is a diagram of an example of a preferred phase characteristic of an embodiment of the modulation means.
Figure 17:
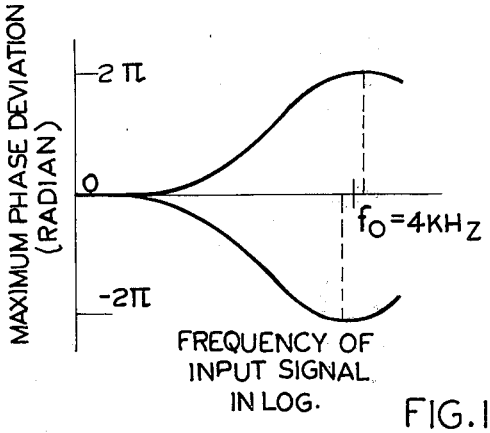
FIG. 17 is a diagram of an example of a preferred phase deviation characteristic of an embodiment of a modulation means.

If said three center frequencies are equal, that is, $$f_o = 1/(2\pi R_1C_1) = 1/(2\pi R_2C_2) = 1/(2\pi R_3C_3), \qquad 2$$

the total phase shift characteristic vs frequency becomes a curved line Z′ shown in FIG. 13. By setting the center frequency $f_o$ near the highest frequency of the audio frequency range and further setting the A.C. modulating power supplies $e_1$, $e_2$ and $e_3$ at the same frequency and the same phase, the modulation means shown in FIG. 15 has a phase shifting characteristic and fluctuation characteristic as shown in FIG. 10, and the phase deviation characteristic as shown in FIG. 11. A number of shifting circuits greater than three, and preferably 10 in number, can be connected in cascade. Preferred examples of the phase shifting characteristic and the phase deviation characteristic are shown in FIG. 16 and FIG. 17, respectively, where the maximum phase deviation exceeds $\pm\pi/2$ radians and reaches $\pm 2\pi$radians.

A third embodiment of a modulation means will now be described. The phase shifting circuit shown in FIG. 12, for example, has a phase shifting characteristic fluctuating in a direction parallel to the frequency axis in accordance with the fluctuation of the center frequency $f_o(=\frac{1}{2}\pi RC)$, as shown in FIG. 18, and has a maximum phase deviation characteristic restricted in some frequency band as shown in FIG. 19. When $1/(2\pi R_1C_1)$, $1/(2\pi R_2C_2)$, $1/(2\pi R_3C_3)$, $e_1$, $e_2$, $e_3$, $F_1$, $F_2$, $F_3$, $\alpha_1$, $\alpha_2$ and $\alpha_3$, of the phase shifting circuits 301, 302 and 303, shown in FIG. 15, are related to each other in the following manner:

$$1/(2\pi R_1C_1) < 1/(2\pi R_2C_2) < 1/(2\pi R_3C_3) \qquad 3$$

$$e_1 < e_2 < e_3 \qquad (4)$$

$$F_1 + F_2 = F_3 \qquad (5)$$

$$\alpha_1 = \alpha_2 = \alpha_3 \qquad (6)$$

the maximum phase deviation of the phase shifting circuits 301, 302 and 303 are shown by the curved lines 401, 402 and 403, respectively, and the total maximum phase deviation is shown by dotted curves 404 in FIG. 20. Although the phase deviation achieved by one phase shifting circuit is not more than $\pm\pi/2$ radians, a greater phase deviation can be achieved by cascading a plurality of phase shifting circuits which have the same characteristic as each other. Therefore, any phase deviation characteristic can be achieved by using more than three phase shifting circuits and by arranging the center frequencies and amounts of the phase deviation in a suitable relation as described above.

By keeping the frequencies $F_1$, $F_2$ and $F_3$ at the same frequencies as in equation (5) and changing the phases $\alpha_1$, $\alpha_2$ and $\alpha_3$ to $$\alpha_1 \quad \alpha_2 \quad \alpha_3, \alpha_3 \quad \alpha_1, \qquad (7)$$

the maximum phase deviation decreases in the overlapping range between 402 and 401 or 403 in FIG. 20. As a result, the undulations in the maximum phase deviation increase with an increase of the frequency of the input signal applied to the input terminal 310 as shown in FIG. 21.

When the modulation frequencies $F_1$, $F_2$ and $F_3$ are in the relationship $$F_1 < F_2 < F_3, \qquad (8)$$

the modulation frequency of the modulation means shown in FIG. 15 increases with increasing frequency of the input signal applied to the input terminal 310.

In the relationship (8), the frequencies $F_1$, $F_2$ and $F_3$ can be in a harmonic relationship, and further can have the same phase as each other.

In the relationship (8), the frequencies $F_1$, $F_2$ and $F_3$ can also be in a non-harmonic relationship.

A number of phase shifting circuits greater than 3 can be used for more complex effects.

The device according to the invention can be made by using modulation means which are phase shifting circuits other than that of FIG. 12.

The same effects mentioned above can be obtained by mechanical methods to change the delay time, the resistance of the resistor or the reactance of the reactor.

The modulation means and the modulators mentioned above can be frequency modulators because frequency modulation is similar to phase modulation.

The present invention can be embodied in a device for producing a tremulant effect comprising a frequency range separator separating an audio frequency signal into a plurality of sub-band signals; at least one modulation system having plural transmission channels coupled to said frequency range separator through one distributing means, at least one of said transmission channels being provided with modulation means producing modulation signals which have a frequency in a sub-audio frequency range, and at least one of which is different in phase from the remainder, whereby each of said subband signals other than the lowest is fed to said distributing means to form plural distributed signals which are converted into plural transmitted signals through said plural transmission channels; and coupling means for coupling all of said transmitted signals and said lowest sub-band signal with each other electrically and/or accoustically, said modulation means modulating said distributed signals in such a manner that the modulation depth and/or the the modulation frequency increase with an increase in the frequency of said distributed signals.

What is claimed is:

1. An electronic expression device for producing a novel tremulant effect, comprising:

an input terminal to which an audio frequency signal is applied;

a frequency range separator connected to said input terminal for separating an audio frequency signal into a plurality of sub-band signals;

at least one modulation system having a distributing means and a plurality of transmission channels, said distributing means being coupled to said frequency range separator for receiving the sub-band signal other than the lowest frequency sub-band signal therefrom, said plurality of transmission channels being coupled to said distributing means, and at least one of said transmission channels having a modulation means for modulating an input signal of said transmission channel by a modulation signal having a sub-audio frequency in such a manner that the input signal is modulated with a modulation depth increasing as the frequency of said audio frequency signal increases and exceeding $\pm \pi/2$ radians when the modulation is phase modulation and exceeding 100% when the modulation is amplitude modulation in the high frequency range of said audio frequency signal so as to have a different modulation from the signals of at least one of the other transmission channels; and a coupling means coupled to said transmission channels for receiving all of the output signals from said transmission channels and coupled to said frequency separator for receiving said lowest frequency sub-band signal from said frequency separator, said coupling means coupling all said signals with each other, whereby at least one of the plurality of transmission channels puts out an output signal which has a different modulation from the output signals of at least one of the other transmission channels of said plurality of transmission channels, and said coupling means couples the output signals from said plurality of transmission channels and the lowest frequency sub-band signal together in order to produce final output signals, at least one vector of which fluctuates differently from other vectors in a frequency range other than said lowest frequency sub-band.

2. A device as claimed in claim 1 wherein there is a plurality of transmission channels, each having a modulation means therein, and at least one modulation means producing a sub-audio frequency modulation signal which has a different phase from the modulation signals produced by the other modulation means.

3. A device as claimed in claim 2 wherein said modulation means comprises a plurality of phase shifting circuits connected in cascade, each of said phase shifting circuits having a constant amplitude gain and a phase shift which changes gradually from zero radians to $-\pi$ radians with an increase in the frequency of said audio signal, the total amount of phase shift of said phase shifting means fluctuating at said sub-audio modulation frequency so that the phase deviation of said phase shifting means increases with an increase in the frequency of said audio frequency signal.

4. A device as claimed in claim 3 wherein said phase shifting circuit comprises a phase splitting means splitting an input signal of said phase splitting means into two signals having phases opposite to each other, and a coupling device which comprises a resistor and a reactor, and which combines said two signals into one output signal, whereby the product of the resistance of said resistor and the reactance of said reactor fluctuates at the frequency of said sub-audio frequency range.

5. A device as claimed in claim 1 wherein said coupling means comprises at least one power amplifier connected to said transmission channels, a further power amplifier connected to said freqeuncy range separator for receiving the lowest frequency sub-band signal therefrom, and a plurality of electro-acoustic transducers connected to said power amplifiers, respectively, for transducing said plurality of transmitted signals and said lowest frequency sub-band signal into sounds, respectively, and combine said sounds.

6. A device as claimed in claim 1 wherein said frequency range separator comprises means for separating said audio frequency signal into two sub-band signals, the distributing means being coupled to said frequency range separator for receiving the higher frequency sub-band signal therefrom, there being a single modulation system having two transmission channels each having a modulation means therein, and the modulation signals of said modulation means are different in phase from each other.

7. A device as claimed in claim 6 wherein said coupling means comprises two electrical coupling means, one coupled to said frequency range separator for receiving the lowest frequency sub-band signal therefrom and also coupled to one of said transmission channels, and the other coupled to said frequency range separator for receiving the lowest frequency sub-band signal therefrom and also coupled to the other of said transmission channels, two power amplifiers connected to the respective electrical coupling means, and two electroacoustic transducers connected to the respective power amplifiers for acoustically combining the signals from the power amplifiers.

8. A device as claimed in claim 1 wherein said frequency range separator comprises means for separating said audio frequency signal into two sub-band signals, the distributing means being coupled to said frequency range separator for receiving the higher frequency sub-band signal therefrom, there being a single modulation system having two transmission channels and only one channel having a modulating means therein and the other channel being a lead.

9. An electronic expression device as claimed in claim 1 in which said coupling means are electrical coupling means coupling said signal electrically.

10. An electronic expression device as claimed on claim 1 in which said coupling means are acoustic coupling means and couple said signal acoustically.

11. An electronic expression device as claimed in claim 1 in which said coupling means is a combined electric and acoustic coupling means coupling said signals partially electrically and partially acoustically.

12. A device as claimed in claim 1 wherein said coupling means comprises at least one electrical coupling means coupled to said transmission channels for receiving the signals therefrom and to said frequency range separator for receiving the lowest frequency sub-band signal therefrom, at least one power amplifier connected to said electrical coupling means, and at least one electro-acoustic transducer connected to said power amplifier.

13. An electronic expression device for producing a novel tremulant effect, comprising:

an input terminal to which an audio frequency signal is applied;

a frequency range separator connected to said input terminal for separating an audio frequency signal into a plurality of sub-band signals;

at least one modulation system having a distributing means and a plurality of transmission channels, said distributing means being coupled to said frequency range separator for receiving the sub-band signal other than the lowest frequency sub-band signal therefrom, said plurality of transmission channels being coupled to said distributing means, and at least one of said transmission channels having a modulation means for modulating an input signal of said transmission channel by a modulation signal having a sub-audio frequency in such a manner that the input signal is modulated with a modulation depth increasing as the frequency of said audio frequency signal increases and exceeding 100 percent in amplitude modulation in the high frequency range of said audio frequency signal so as to have a different modulation from the signals of at least one of the other transmission channels; and a coupling means coupled to said transmission channels for receiving all of the output signals from said transmission channels and coupled to said frequency separator for receiving said lowest frequency sub-band signal from said frequency separator, said coupling means coupling all said signals with each other, whereby at least one of the plurality of transmission channels puts out an output signal which has a different modulation from the output signals of at least one of the other transmission channels of said plurality of transmission channels, and said coupling means couples the output signals from said plurality of transmission channels and the lowest frequency sub-band signal together in order to produce final output signals, at least one vector of which fluctuates differently from other vectors in a frequency range other than said lowest frequency sub-band.

14. An electronic expression device for producing a novel tremulant effect, comprising:

an input terminal to which an audio frequency signal is applied;

a frequency range separator connected to said input terminal for separating an audio frequency signal into a plurality of sub-band signals;

at least one modulation system having a distributing means and a plurality of transmission channels, said distributing means being coupled to said frequency range separator for receiving the sub-band signal other than the lowest frequency sub-band signal therefrom, said plurality of transmission channels being coupled to said distributing means, and at least one of said transmission channels having a modulation means for modulating an input signal of said transmission channel in amplitude and phase by a modulation signal having a sub-audio frequency in such a manner that the input signal is modulated with a modulation depth increasing as the frequency of said audio frequency signal increases and exceeding $\pm\pi/2$ radians in phase and exceeding 100 percent in amplitude in the high frequency range of said audio frequency signal so as to have a different modulation from the signals of at least one of the other transmission channels; and a coupling means coupled to said transmission channels for receiving all of the output signals from said transmission channels and coupled to said frequency separator for receiving said lowest frequency sub-band signal from said frequency separator, said coupling means coupling all said signals with each other, whereby at least one of the plurality of transmission channels puts out an output signal which has a different modulation from the output signals of at least one of the other transmission channels of said plurality of transmission channels, and said coupling means couples the output signals from said plurality of transmission channels and the lowest frequency sub-band signal together in order to produce final output signals at least one vector of which fluctuates differently from other vectors in a frequency range other than said lowest frequency sub-band.

15. An electronic expression device for producing a novel tremulant effect, comprising:

an input terminal to which an audio frequency signal is applied;

a frequency range separator connected to said input terminal for separating an audio frequency signal into a plurality of sub-band signals;

at least one modulation system having a distributing means and a plurality of transmission channels, said distributing means being coupled to said frequency range separator for receiving the sub-band signal other than the lowest frequency sub-band signal therefrom, said plurality of transmission channels being coupled to said distributing means, and at least one of said transmission channels having a modulation means for modulating an input signal of said transmission channel by a modulation signal having a sub-audio frequency in such a manner that the input signal is modulated with a modulation depth increasing as the frequency of said audio frequency signal increases and exceeding $\pm\pi/2$ radians when the modulation is phase modulation and exceeding 100 percent when the modulation is amplitude modulation in the high frequency range of said audio frequency signal so as to have a different modulation from the signals of at least one of the other transmission channels, said modulation means being composed at least of a delay network having a constant amplitude gain and a phase shift which increases in the rate of the increment with an increase in the frequency of said audio frequency signal and said phase shift fluctuates in said sub-audio frequency; and a coupling means coupled to said transmission channels for receiving all of the output signals from said transmission channels and coupled to said frequency separator for receiving said lowest frequency sub-band signal form said frequency separator, said coupling means coupling all said signals with each other, whereby at least one of the plurality of transmission channels puts out an output signal which has a different modulation from the output signals of at least one of the other transmission channels of said plurality of transmission channels, and said coupling means couples the output signals from said plurality of transmission channels and the lowest frequency sub-band signal together in order to product final output signals, at least one vector of which fluctuates differently from other vectors in a frequency range other than said lowest frequency sub-band.

16. An electronic expression device for producing a novel tremulant effect, comprising;

an input terminal to which an audio frequency signal is applied;

a frequency range separator connected to said input terminal for separating an audio frequency signal into a plurality of sub-band signals:

at least one modulation system having a distributing means and a plurality of transmission channels, said distributing means being coupled to said frequency range separator for receiving the sub-band signal other than the lowest frequency sub-band signal therefrom, said plurality of transmission channels being coupled to said distributing means, and at least one of said transmission channels having a modulation means for modulating an input signal of said transmission channel in such a manner that the input signal is modulated with a modulation depth increasing as the frequency of said audio frequency signal increases and exceeding $\pm\pi/2$ radians when the modulation is phase modulation and exceeding 100 percent when the modulation is amplitude modulation in the high frequency range of said audio frequency signal so as to have a different modulation from the signals of at least one of the other transmission channels, said modulation means being composed of a plurality of phase shifting circuits which have a constant amplitude gain and a phase shift increasing with an increase in the frequency, the amount of said phase shift fluctuating in accordance with a plurality of modulation signals of sub-audio frequency range so that said phase shifting circuits produce phase modulations in frequency bands, said plurality of phase shifting circuits being connected in cascade, and said plurality of modulation signals having at least one of a different phase and a different frequency; and a coupling means coupled to said transmission channels for receiving all of the output signals from said transmission channels and coupled to said frequency separator for receiving said lowest frequency sub-band signal from said frequency separator, said coupling means coupling all said signals with each other, whereby at least one of the plurality of transmission channels puts out an output signal which has a different modulation from the output signals of at least one of the other transmission channels of said plurality of transmission channels, and said coupling means couples the output signals from said plurality of transmission channels and the lowest frequency sub-band signal together in order to produce final output signals, at least one vector of which fluctuates differently from other vectors in a frequency range other than said lowest frequency sub-band.

* * * * *

UNITED STATES PATENT AND TRADEMARK OFFICE

CERTIFICATE OF CORRECTION

PATENT NO. 3,941,025

DATED : March 2, 1976

INVENTOR(S) : KINJI KAWAMOTO

It is certified that error appears in the above-identified patent and that said Letters Patent are hereby corrected as shown below:

Column 10, line 57, for "$f_o$ 1/2 = $\pi$RC" read --$f_o$ = 1/2$\pi$RC--.

Column 11, line 58 for "2" (last occurrence) read --(2)--.

Column 12, line 20, for "3" (last occurrence) read --(3)--.

Column 12, line 22, for "$F_1 + F_2 = F_3$" read --$F_1 = F_2 = F_3$--.

Column 12, line 40, for " $\alpha_1$ $\alpha_2$ $\alpha_3$, $\alpha_3$ $\alpha_1$," read --$\alpha_1 \neq \alpha_2 \neq \alpha_3$, $\alpha_3 \neq \alpha_1$,--.

In Fig. 15 intersection of lines in center of dotted line box 300 should show as interconnection, and resistance R in dotted line box 302 should show as $R_9$.

Signed and Sealed this

Thirtieth Day of November 1976

[SEAL]

*Attest:*

RUTH C. MASON
*Attesting Officer*

C. MARSHALL DANN
*Commissioner of Patents and Trademarks*